United States Patent [19]

Ricouard et al.

[11] Patent Number: 4,551,998

[45] Date of Patent: Nov. 12, 1985

[54] BAGGAGE CLOSURE

[75] Inventors: Jacques Ricouard; Claude Chappoux, both of Sancoins, France

[73] Assignees: L.A. Ricouard S.A., Courbevoie; Ronis S.A., Cedex, both of France

[21] Appl. No.: 530,594

[22] PCT Filed: Jan. 7, 1983

[86] PCT No.: PCT/EP83/00003

§ 371 Date: Aug. 23, 1983

§ 102(e) Date: Aug. 23, 1983

[87] PCT Pub. No.: WO83/02478

PCT Pub. Date: Jul. 21, 1983

[30] Foreign Application Priority Data

Jan. 12, 1982 [FR] France ..... 82 00341

[51] Int. Cl.[4] ..... E05B 65/52

[52] U.S. Cl. ..... 70/69; 70/215; 70/379 R; 292/210

[58] Field of Search ..... 70/69–76, 70/215, 197, 379 R; 292/210

[56] References Cited

U.S. PATENT DOCUMENTS

| | | | |
|---|---|---|---|
| 2,720,772 | 10/1955 | Atkinson . | |
| 3,103,115 | 9/1963 | Atkinson . | |
| 3,266,275 | 8/1966 | Atkinson | 70/70 |
| 3,394,958 | 7/1968 | Rosing et al. | 70/70 X |
| 3,412,832 | 11/1968 | Jamison . | |
| 3,616,666 | 11/1971 | Atkinson | 70/70 |
| 3,646,787 | 3/1972 | Norrenberg-Sudhaus | 70/70 |

FOREIGN PATENT DOCUMENTS

| | | | |
|---|---|---|---|
| 717602 | 10/1966 | Italy | 70/69 |

*Primary Examiner*—Gary L. Smith
*Assistant Examiner*—Lloyd A. Gall
*Attorney, Agent, or Firm*—Karl F. Ross; Herbert Dubno

[57] ABSTRACT

The baggage closure incorporates a closing lever which carries a cylinder rotatable by means of a key and intended for locking the closing lever in the closing position. According to the invention, the cylinder (3) has a cam (7) which interacts with a lug (8) on the mounting (2) of the closing lever (1). Located on the closing lever (1) is an extension (9) which interacts with an orifice (16) in a closure fitting (10) fastened to the baggage.

1 Claim, 6 Drawing Figures

BAGGAGE CLOSURE

CROSS REFERENCE TO RELATED APPLICATIONS

This application is a national phase application corresponding to PCT/EP 83/00003 filed Jan. 7, 1983 and based upon the French national application 82 00341 of Jan. 12, 1982, the priority of which is claimed under the International Convention.

FIELD OF THE INVENTION

The invention relates to a baggage closure with a closing lever and with a cylinder rotatable by means of a key and intended for locking the closing lever in the closing position.

BACKGROUND OF THE INVENTION

In known luggage-closing devices of this type, the closing lever is articulated on a sliding piece which acts as a locking bar via a rod. This device is complicated and expensive.

A simpler device is also already known, and in this locking is carried out directly by means of a cam located on the cylinder and interacting with a closure fitting and in which the closing lever is pressed into the opening position by a spring. The mechanical strength of such a device is insufficient, especially when the baggage is subjected to deformation.

OBJECT OF THE INVENTION

The object of this invention is, therefore, to provide a closure of the type described above, which combines great simplicity with high mechanical strength.

SUMMARY OF THE INVENTION

This object is achieved, according to the invention, when the cylinder has a cam which interacts with a lug on the mounting of the closing lever, and the closing lever has an extension which interacts with an orifice in a closure fitting.

In the extremely simple device according to the invention, locking of the closing lever and closure of the baggage are achieved by means of two different parts, with the result that the resistance capacity of the closure, especially in the event of deformation of the baggage, is increased.

BRIEF DESCRIPTION OF THE DRAWING

The invention is explained in greater detail with reference to the drawing in which.

SPECIFIC DESCRIPTION

Figure 1:
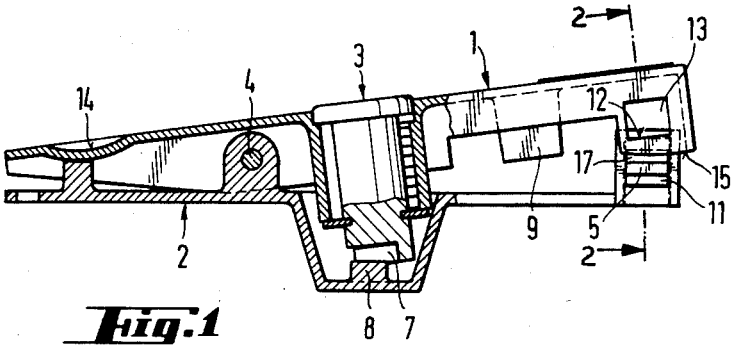
FIG. 1 is a side view, partially in longitudinal section, of an embodiment of the closure according to the invention, in the opening position.
Figure 2:
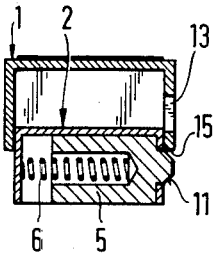
FIG. 2 is a sectional view along the line 2—2 of FIG. 1.
Figure 3:
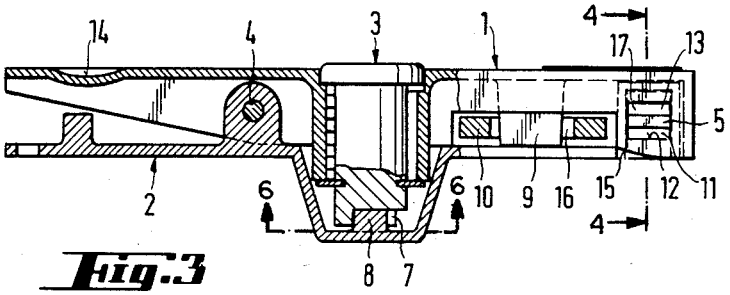
FIG. 3 is a view similar to FIG. 1, with the device in the closing position.
Figure 4:
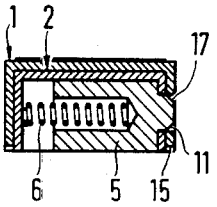
FIG. 4 is a sectional view along the line 4—4 of FIG. 3.
Figure 5:
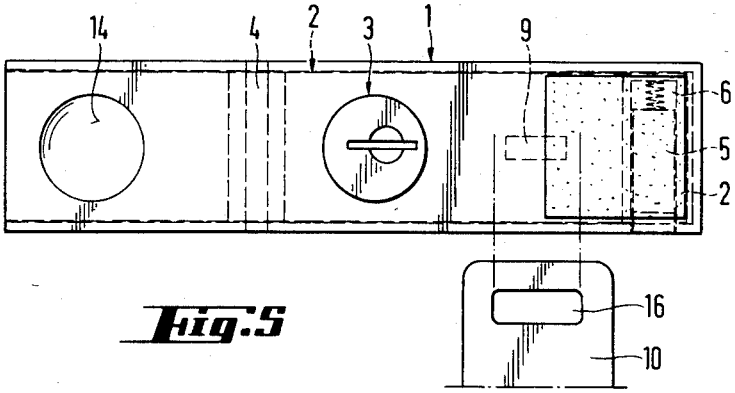
FIG. 5 is a plan view of the device illustrated in FIGS. 1 to 4, during closure via the closure fitting.
Figure 6:
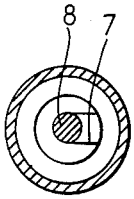
FIG. 6 is a cross-sectional view taken along the line 6—6 of FIG. 3 to show the cooperation of the eccentric part or cam and the lug.

The device consists of a closing lever 1 and of a mounting 2. The closing lever 1 carries a rotatable lock cylinder 3 which can be actuated by a coded key (not shown) and which is articulated on the mounting 2 by means of a pin 4 forming the axis of rotation.

At one end, the mounting 2 contains a sliding piece 5 which is pressed outwards by a spring 6. The inner end of the cylinder 3 has a cam 7 which, in the closing position of the lever 1, comes up against a suitably shaped lug 8 on the mounting 2 when the cylinder 3 is rotated. The closing lever 1 is provided with an extension 9 which, during closure, penetrates into an orifice 16 in a closure fitting 10 connected to the lid of the item of baggage.

The sliding piece 5 is limited on the inside by a slope 11 which, in the closing position, interacts with the edge 12 of a cut-out 13 in the closing lever and which gives the lever 1 stable positioning. The end of the closing lever 1 located opposite the cut-out 13 has a recess 14 to make it easier for the user to press his thumb on it.

In the closing position, unlocking is carried out by rotating the cylinder 3, with the result that the cam 7 is moved away from the lug 8. Pressure on the recess 14 causes the closing lever 1 to rotate, the slope 11 of the sliding piece 5 sliding along on the edge 12 of the cut-out 13 and inwards against the effect of the spring 6. At the end of the rotation of the closing lever 1, the sliding piece 5 is located outside the closing lever 1 and comes up against the edge of the closing lever 1, the position of which is stabilised as a result. It should be noted that the pivot pin 4 is arranged so that the closing force (exerted by pressure on the closing lever in the region of the cut-out 13) is much less than the opening force.

We claim:

1. A baggage closure comprising:

a mounting formed with a sliding piece pressed outwardly by a spring and provided at a location spaced from said sliding piece with a lug;

a closing lever pivotally mounted on said mounting and provided with a cutout which, in a closing position of said lever is aligned with an end of said sliding piece located opposite said spring and engaged by said sliding piece; and a lock cylinder rotatable on said lever upon insertion of a key in said cylinder for locking said lever in a closing position, said lock cylinder being axially aligned with said lug and being formed with an eccentric part rotatable about said lug upon insertion of said key into said lock cylinder from a position in which said eccentric part engages said lug to prevent pivotal movement of said lever on said mounting into a position in which said eccentric part clears said lug to permit pivotal movement of said lever on said mounting into an opening position of said closure.

* * * * *